US006428097B1

(12) United States Patent
Amemiya et al.

(10) Patent No.: US 6,428,097 B1
(45) Date of Patent: Aug. 6, 2002

(54) DEPLOYABLE BLEACHER/CHAIR COMBINATION

(75) Inventors: Minoru Amemiya, Kalamazoo; Richard L. Patterson, Delton; Melvin J. Guiles, West Olive, all of MI (US)

(73) Assignee: Interkal, Inc., Kalamazoo, MI (US)

( * ) Notice: Subject to any disclaimer, the term of this patent is extended or adjusted under 35 U.S.C. 154(b) by 0 days.

(21) Appl. No.: 09/687,806

(22) Filed: Oct. 13, 2000

Related U.S. Application Data

(60) Provisional application No. 60/159,855, filed on Oct. 15, 1999.

(51) Int. Cl.[7] ..... A47C 15/00; A47C 7/62

(52) U.S. Cl. ..... 297/217.7; 297/236; 52/8; 52/9

(58) Field of Search ..... 297/217.7, 234, 297/235, 236; 52/8, 9

(56) References Cited

U.S. PATENT DOCUMENTS

| | | | | | |
|---|---|---|---|---|---|
| 3,025,106 | A | * | 3/1962 | Evans et al. | 297/217.7 X |
| 4,063,392 | A | * | 12/1977 | Van Ryn et al. | 52/9 X |
| 4,155,202 | A | * | 5/1979 | Hartman | 52/9 |
| 4,557,080 | A | * | 12/1985 | Walworth et al. | 52/9 |
| 5,459,964 | A | * | 10/1995 | Doublet | 52/8 X |
| 6,244,657 | B1 | * | 6/2001 | Momose | 297/217.7 |

* cited by examiner

*Primary Examiner*—Anthony D. Barfield
(74) *Attorney, Agent, or Firm*—Raphael A. Monsanto; Benita J. Rohm; Richard A. Gaffin

(57) ABSTRACT

A deployable bleacher arrangement has deployed and un-deployed states and is provided with a plurality of seating level members, each arranged in sequentially elevated relation to one another. Each seating level member is disposed beneath an immediately superior seating level member in stacked relation when in the un-deployed state. In the deployed state, each seating level member is disposed beneath and forward of an immediately superior seating level member. A plurality of seats are disposed in side-by-side relation on a seating level member. Each of the seats has a bottom portion coupled to the associated seating level member for accommodating a user. The seat bottom has forward and rear portions and is arranged parallel to the associated seating level member. Additionally, a seat back is disposed in the vicinity of the rear portion of the seat bottom, and is pivotally displaceable with respect to the associated seating level member between a first position where the seat back is disposed orthogonal to the set bottom and a second position where the seat back is rearwardly declined to be parallel to the seat bottom. A linkage arrangement pivotally couples the seat back to the seating level member of the bleacher arrangement to secure the seat back in the first position. The linkage arrangement is releaseable so that the seat back can assume the second position. An unlocking arrangement urges the linkage arrangements associated with each seat into simultaneous release conditions.

9 Claims, 10 Drawing Sheets

DEPLOYABLE BLEACHER/CHAIR COMBINATION

RELATIONSHIP TO OTHER APPLICATION

This application claims the benefit of provisional patent application No. 60/159,855, filed Oct. 15, 1999, by the same applicants as herein.

BACKGROUND OF THE INVENTION

1. Field of the Invention

This invention relates generally to deployable seating arrangements, and more particularly, to a deployable bleacher seating arrangement wherein there are provided a plurality of seats for individual users, each seat having an associated seat bottom and seat back.

2. Description of the Related Art

Deployable bleacher seating arrangements generally are provided with a plurality of seating levels, formed of wood, whereby the users are required to sit on the equivalent of a bench seat. Such a seating condition is uncomfortable during extended seating periods. Additionally, bare wood bench seating oftentimes is inappropriately informal for certain events.

Acceptable levels of comfort and formality can be achieved by installing a plurality of individual chairs or seats directly on the various seating levels of the deployable bleacher arrangement. This approach, however, is deficient in that seat backs of adequate height would preclude un-deployment of the bleacher arrangement. That is, when it is desired to restore the bleacher arrangement to its original, undeployed condition, the seat backs would interfere with their immediately superior seating rows, thereby impeding restoration of the bleacher arrangement to an undeployed state. In many convention bleacher seating systems, the problem of seat back interference with a superior row cannot readily be corrected by allowing the seat backs to be folded forward over the seat bottoms, as the stacked seat bottoms and seat backs also are of sufficient height to cause interference during un-deployment.

There is, therefore, a need for a deployable bleacher seating arrangement that can be provided with individual seats with seat backs that do not interfere with immediately superior rows during un-deployment. It is additionally desired that this functionality be achieved without increasing the height between adjacent seating levels.

SUMMARY OF THE INVENTION

The foregoing needs in the prior art are fulfilled by this invention which provides a deployable bleacher arrangement of the type having deployed and undeployed states. In accordance with the invention, there is provided a plurality of seating level members each having first and second ends and arranged in sequentially elevated relation to one another by a first predetermined height. Each such seating level member is disposed substantially directly beneath an immediately superior seating level member in substantially stacked relation when the deployable seating arrangement is in the undeployed state. Additionally, each such seating level member is disposed beneath and forward of an immediately superior seating level member in stepped relation when the deployable seating arrangement is in the deployed state. There is also provided a plurality of seats disposed side-by-side on an associated one of the seating level members. Each of the seats has a seat bottom coupled to the associated seating level member for accommodating a user of the deployable bleacher arrangement, the seat bottom having forward and rear portions and arranged substantially parallel to the associated seating level member. Each seat also has a seat back disposed in the vicinity of the rear portion of the seat bottom, the seat back being pivotally displaceable with respect to the associated seating level member between a first position where the seat back is disposed substantially orthogonal to the seat bottom and a second position where the seat back is disposed substantially parallel to the seat bottom. Additionally, each seat has a linkage arrangement that is pivotally coupled to the seat back having a first position corresponding to the first position of the seat back, and a second position corresponding to the second position of the seat back.

In one embodiment of the invention, the first position of the linkage arrangement has locked and unlocked conditions. An unlocking arrangement urges the linkage arrangement from the locked to the unlocked condition. Each seat back is urged into the second position upon the associated linkage arrangement being urged from the locked to the unlocked condition. The associated seat back is urged into the second position in response to the force of gravity upon the linkage arrangement being urged from the locked to the unlocked condition.

In a further embodiment, there is provided an electrical actuator coupled to the unlocking arrangement for urging the unlocking arrangement to urge the linkage arrangement from the locked to the unlocked condition. The electrical actuator may, in some embodiments, be a solenoid, and in other embodiments, an electric motor. In a highly advantageous embodiment, the unlocking arrangement is configured to urge the linkage arrangement from the locked to the unlocked condition for a plurality of the seats simultaneously.

BRIEF DESCRIPTION OF THE DRAWING

Comprehension of the invention is facilitated by reading the following detailed description, in conjunction with the annexed drawing, in which.

DETAILED DESCRIPTION

Figure 1:
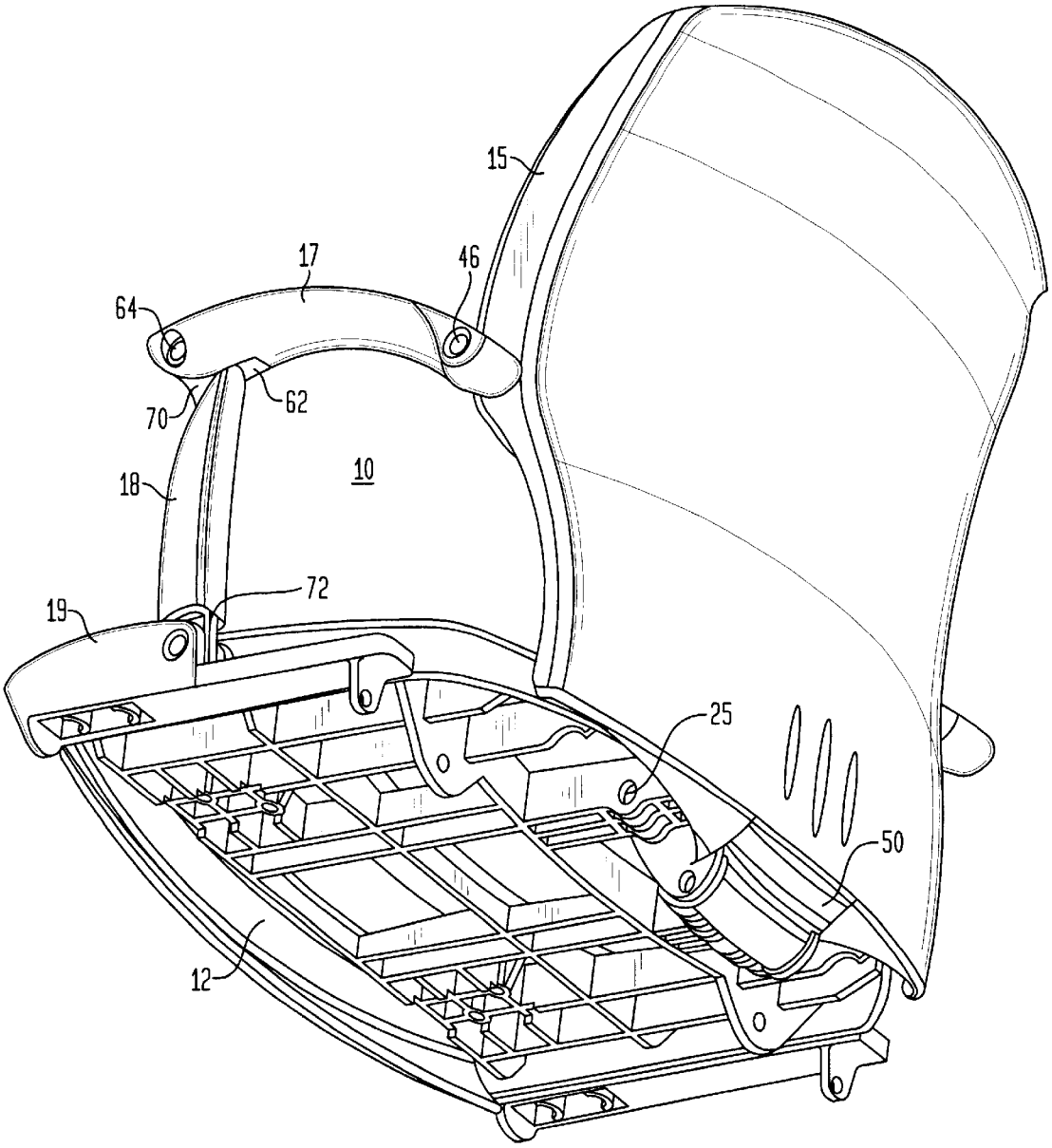
FIG. 1 is a perspective representation of a seat constructed in accordance with the principles of the invention for installation on a deployable bleacher seating arrangement.

FIG. 1 is an isometric representation of a bleacher chair 10 that is constructed in accordance with the principles of the invention for installation on a deployable bleacher (not shown in this figure). Bleacher chair 10 has a seat bottom 12 that will be described in greater detail in connection with FIG. 2. The bleacher chair additionally has a seat back 15, that will be described with respect to FIG. 3; an arm rest 17 shown in greater detail in FIG. 6; an arm rest post 18, shown in detail in FIG. 7; and a base member 19, shown in detail in FIG. 8.

Figure 2:
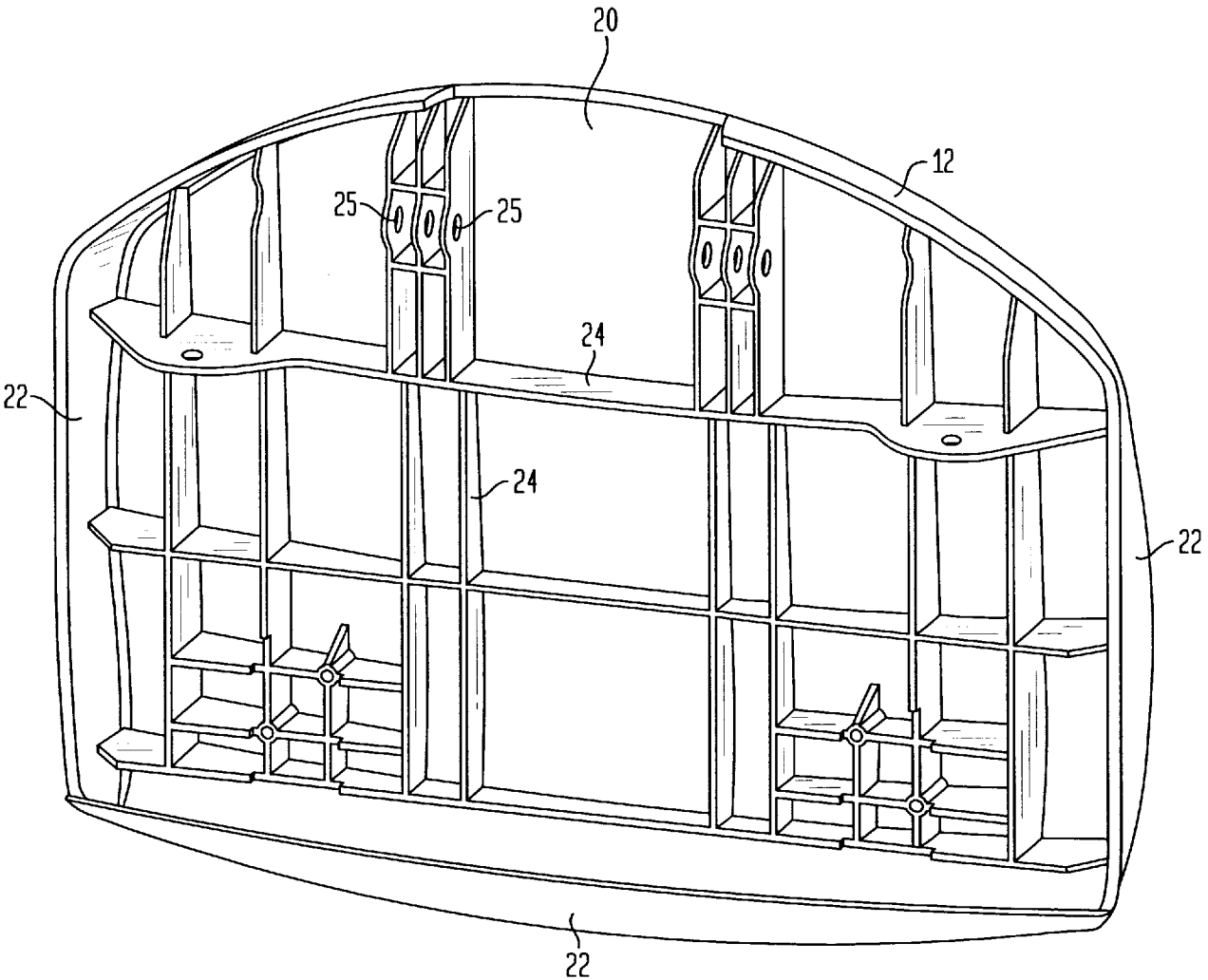
FIG. 2 is an isometric representation of a seat bottom for the embodiment of FIG. 1.

FIG. 2 is an isometric representation showing the underside of seat bottom 12. As shown, the seat bottom is shown to have a seating layer 20 surrounded by a down-turned skirt portion 32. A plurality of structural cross-braces 24 are integrally formed with seating layer 20 and skirt 22. FIGS. 1 and 2 each show a plurality of apertures 25 in registration with one another for accommodating a pivot axle (not shown in this figure) whereby seat back 15 is pivotally coupled to seat bottom 12.

Figure 3:
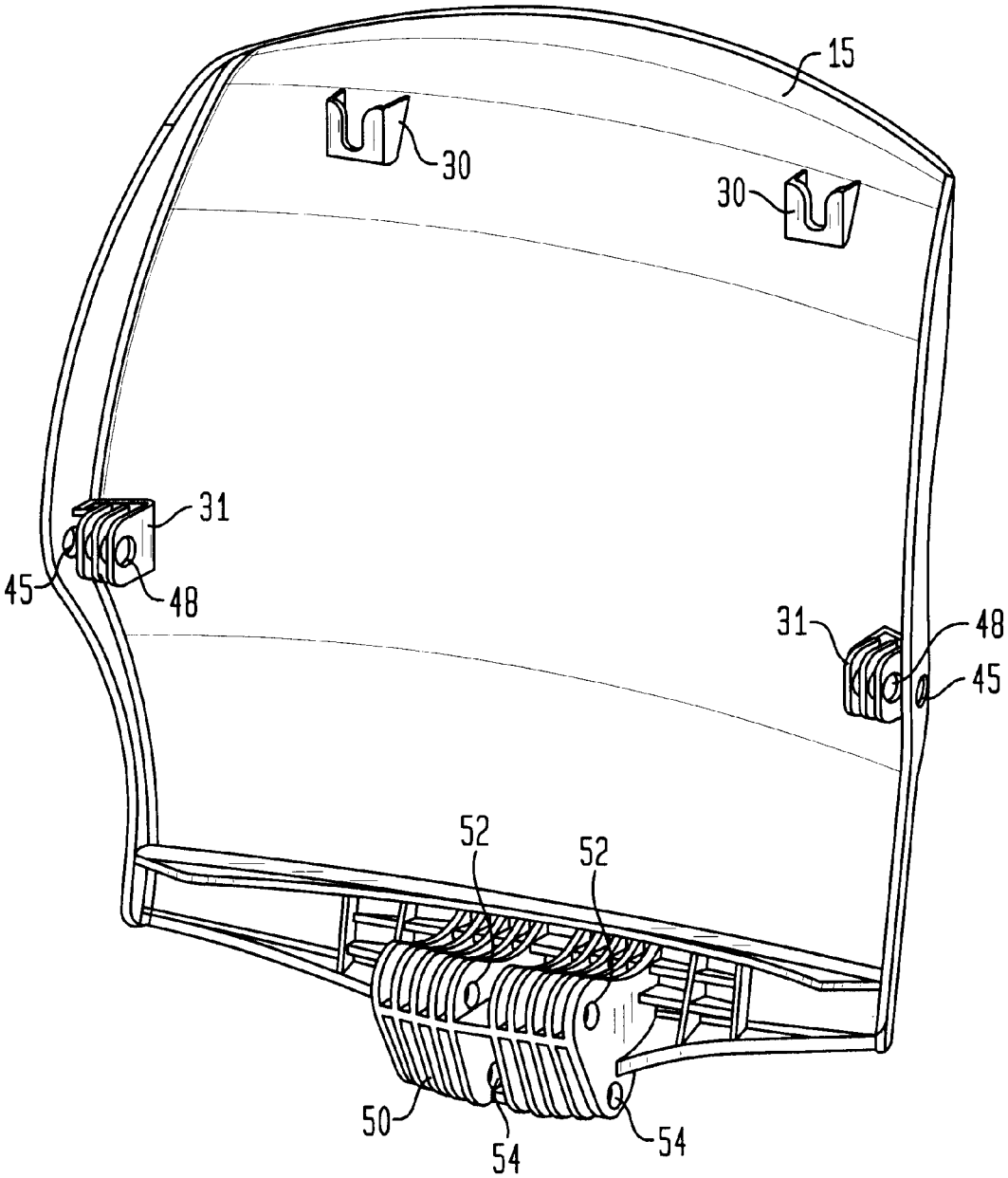
FIG. 3 is an isometric representation of a seat back for the embodiment of FIG. 1.

FIG. 3 is an isometric representation of seat back 15 shown from the front thereof. A plurality of coupling arrangements 30 and 31 couple with a seat back inner liner, as shown in FIG. 4.

Figure 4:
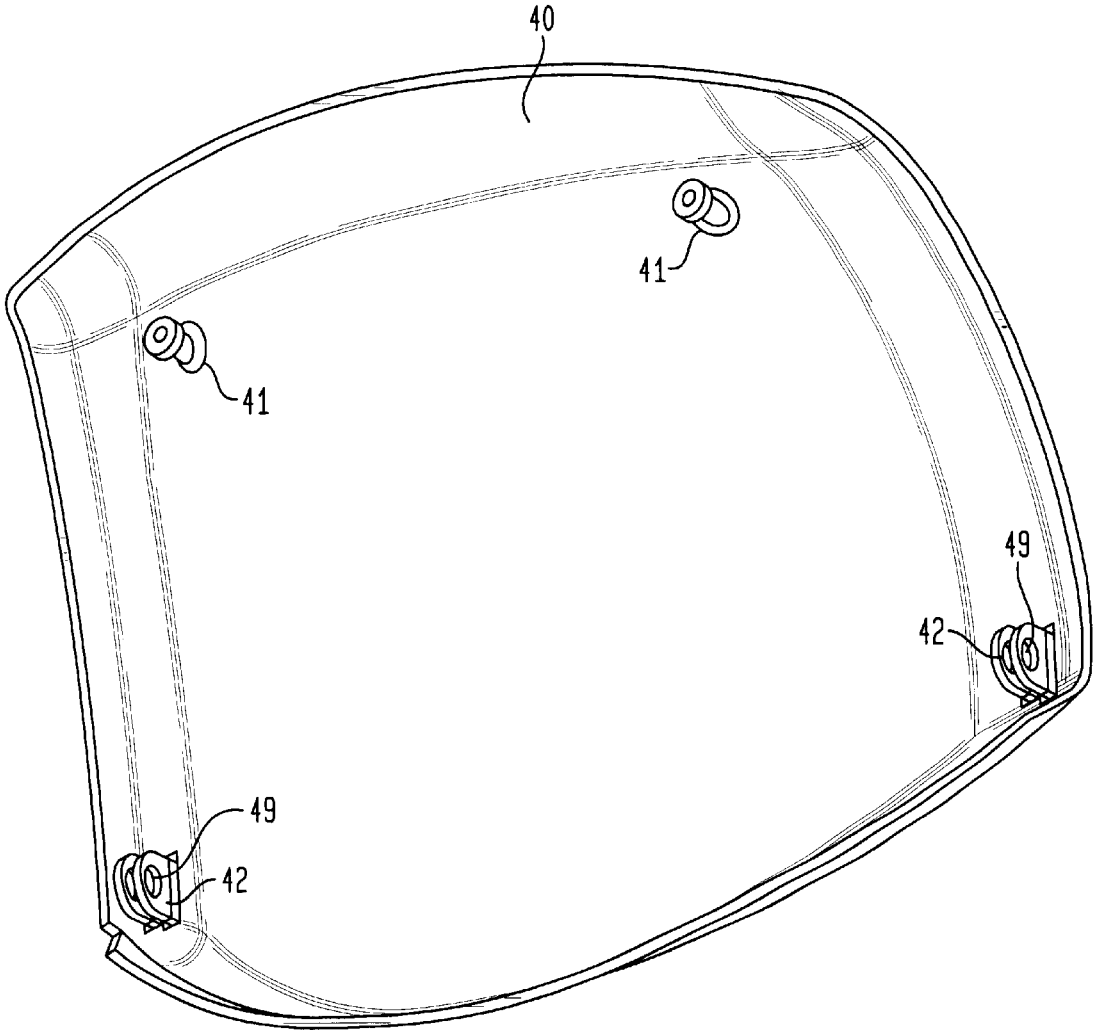
FIG. 4 is an isometric representation of an inner surface portion for the seat back of FIG. 3.

FIG. 4 is an isometric representation of a seat back inner liner 40 that is ergonomically contoured. The seat back inner liner of FIG. 4 is shown from the back side thereof where there are provided coupler portions 41 for engaging with correspondingly configured couplers 30 of seat back 15, and further coupler portions 42 that engage with couplers 31 of the seat back. Engagement between seat back inner liner 40 and seat back 15 is effected by the couplers, and secured thereto by fasteners (not shown in this figure) that are inserted through apertures 45 during installation of arm rest 17. As shown in FIG. 1, arm rest 17 is pivotally coupled at pivot 46 to seat back 15. The fastener that is passed through arm rest 17 and through aperture 45 of the seat back also engages apertures 48 in couplers 31, and apertures 49 in couplers 42 of the seat back inner liner.

FIGS. 1 and 3 show that seat back 15 is provided with a coupling block 50 having a plurality of apertures 52 arranged in registration with one another, and a further plurality of apertures 54 in registration with one another.

Figure 5:
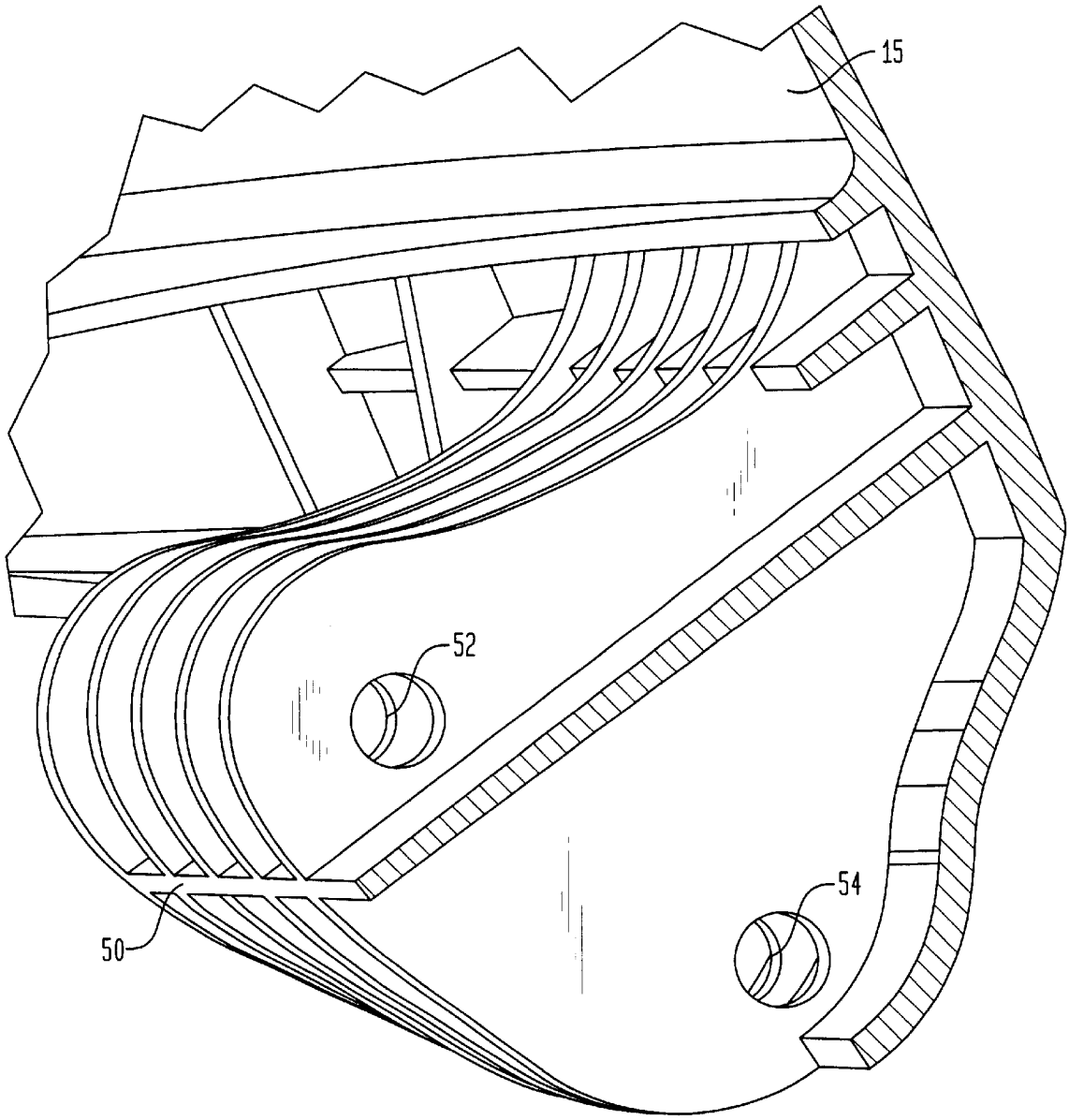
FIG. 5 is an enlarged, partially cross-sectional representation of a coupling portion of the seat back of FIG. 3.

FIG. 5 is an isometric, partly cross-sectional enlarged representation of coupling portion 50 of seat back 15. This figure shows, in greater detail, the structure of coupler portion 50, as well as apertures 52 and 54.

Figure 6:
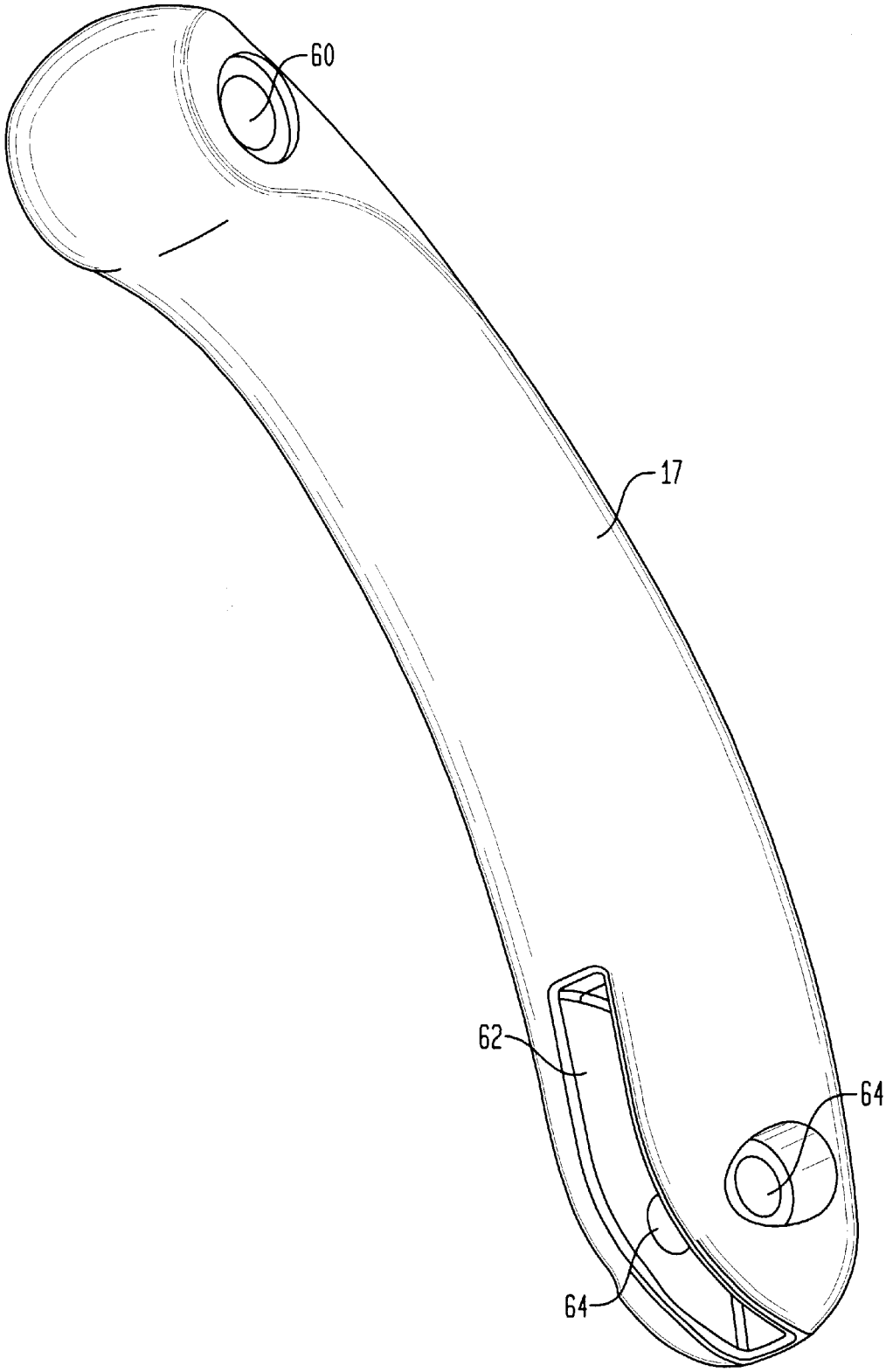
FIG. 6 is an isometric representation of an arm rest for the embodiment of FIG. 1.

FIG. 6 is an isometric enlarged representation of arm rest 17. As shown, arm rest 17 is provided with an aperture 60 through which is axially passed a fastener (not shown) for forming pivot 46 (FIG. 1). In addition, arm rest 17 is shown to have a notch 62 formed therein and a plurality of apertures 64 arranged in registration with one another and transversely across notch 62.

Figure 7:
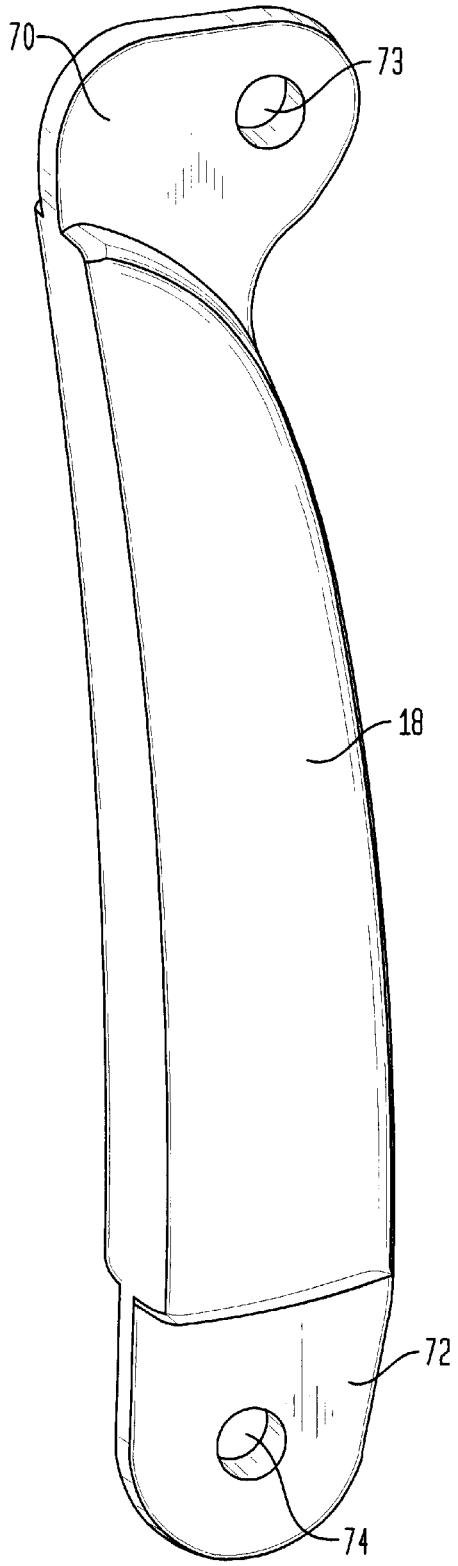
FIG. 7 is an isometric representation of an arm rest post for use in conjunction with the arm rest of FIG. 6.

FIG. 7 is an isometric representation of arm rest post 18, further showing a region 70 of reduced thickness, and a further region 72 also having a reduced thickness. Region 70 is provided with an aperture 73 therethrough, and region 72 is provided with an aperture 74 therethrough. As further shown in FIGS. 1 and 6, region 70 of reduced thickness is accommodated within notch 62 of arm rest 17 whereby aperture 73 is arranged in registration with aperture 64. A fastener (not shown) is inserted axially through apertures 64 and 73 to form a pivot coupling.

Figure 8:
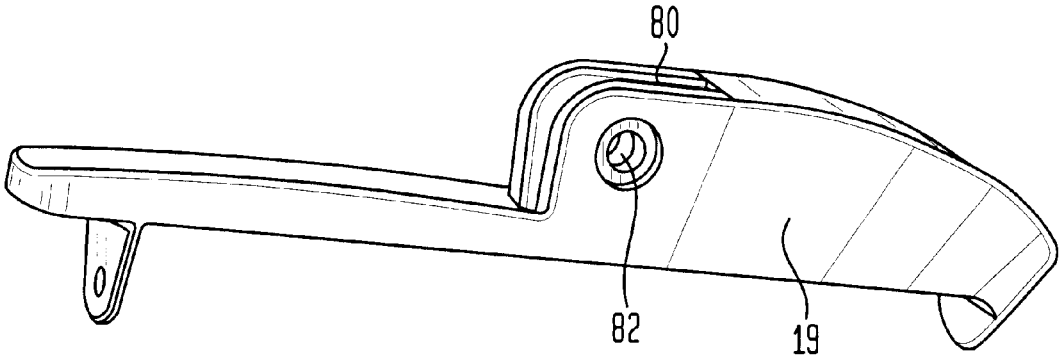
FIG. 8 is an isometric representation of a base portion for use with the arm rest post of FIG. 7.

FIG. 8 is an enlarged isometric representation of base member 19. As shown, base member 19 is provided with a notch 80 having a plurality of apertures 82 arranged in registration with one another and transverse to notch 80. As shown in FIGS. 1 and 7, regions 72 of reduced thickness of arm rest post 18 is accommodated within notch 80 whereby aperture 74 of the arm rest post is arranged to register with apertures 82 of the base member. A fastener (not shown) is passed axially through apertures 82 and 74 to form a pivot coupling.

Referring once again to FIG. 1, it is seen that seat back 15 is permitted to pivot backwards, and such backward pivoting is not impeded by the combination of arm rest 17 and arm rest post 19. More specifically, as the seat back is pivoted backward, the arm rest and the arm rest post collapse pivotally to permit the seat back to become oriented substantially parallel to the seat bottom. In other words, in this embodiment of the invention, seat back 15 is fully reclinable with respect to seat bottom 12.

Figure 9:
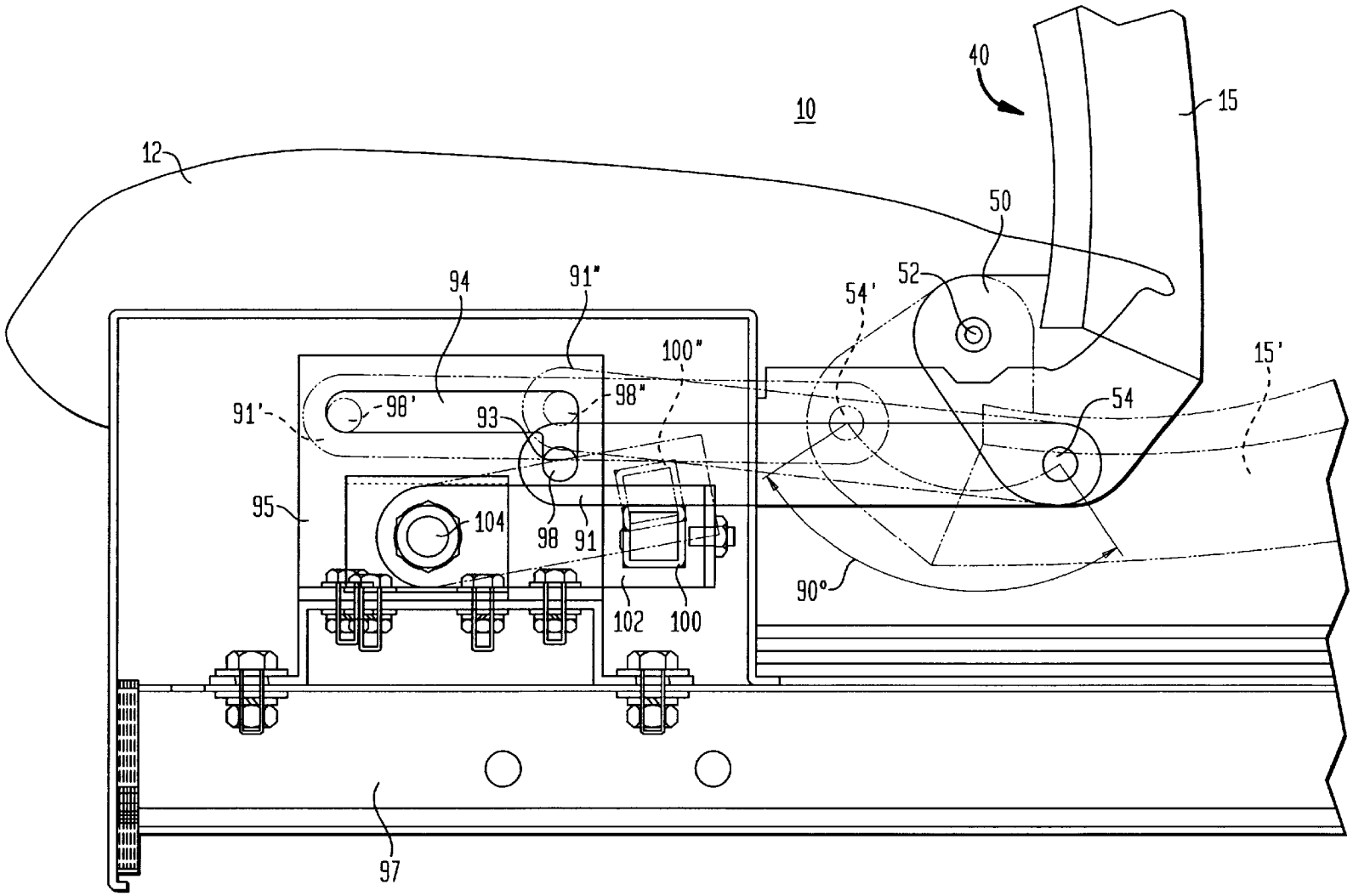
FIG. 9 is a simplified schematic representation of a specific illustrative embodiment of linkage for effecting pivotal displacement of the seat back relative to the seat bottom.

FIG. 9 is a simplified schematic plan view of bleach chair 10 illustrating certain additional elements of structure that control the orientation of seat back 15. Elements of structure that have previously been discussed are similarly designated. This figure shows seat back 15 in fully upright and fully reclined positions. The various elements of structure are shown in solid line when seat back 15 is in the fully upright position, and in phantom when fully reclined. Additionally, references to the elements of structure in the fully reclined condition are designated with a corresponding designation number accompanied by a "′" (i.e., a "prime" symbol), as is the case with seat back 15 and seat back 15' in the reclined condition.

As previously noted, seat back 15 pivots with respect to seat bottom 12 about apertures 52 of coupler portion 50. Thus, when the seat back is pivotally displaced to the fully reclined position, apertures 54 pivot about apertures 52 until they reach the position of apertures 54'. The angular distance between apertures 54 and apertures 54' is shown in the figure to be approximately 90°.

While the seat back is in the fully upright position, a link 91 is pivotally coupled at apertures 54 and its distal end is captured within a well 93 of a guide slot 94. Guide slot 94 is formed within a bracket 95 that is coupled to a bleacher seating level 97. The positioning of a locking rod 98 within well 93 of guide slot 94 prevents apertures 54 from pivotally rotating about apertures 52, and therefore, seat back 15 is securely maintained in the fully upright condition.

When it is desired to permit seat back 15 to recline, a rectangular rod 100 (shown in cross-section section in this figure) is urged upward to position 100". This upward motion of rectangular rod 100 to rectangular rod position 100" is effected, in this embodiment, by pivotally urging a connecting link 102 about a pivot 104. The upward urging of connecting link 102 is performed by any of several known modalities, including manual urging or electrical urging, using, for example, solenoids (not shown in this figure) or motors (not shown in this figure).

The upward urging of connecting link 102 and rectangular rod 100 coupled thereto causes link 91 to be displaced upward to the position of link 91". In this position, locking rod 98 has been displaced to the position of locking rod 98" so as to be axially registered with the horizontal portion of guide slot 94. Since, as shown in this figure, most of the weight of seat back 15 is arranged on the right hand side of apertures 52, the seat back is now permitted to fall backward to the fully reclined position of seat back 15', whereby link 91 travels toward the left hand side of the figure to the position of link 91'. In this position, locking rod 98 is brought to position 98', thereby limiting the extent of the reclining of seat back 15'.

Figure 10:
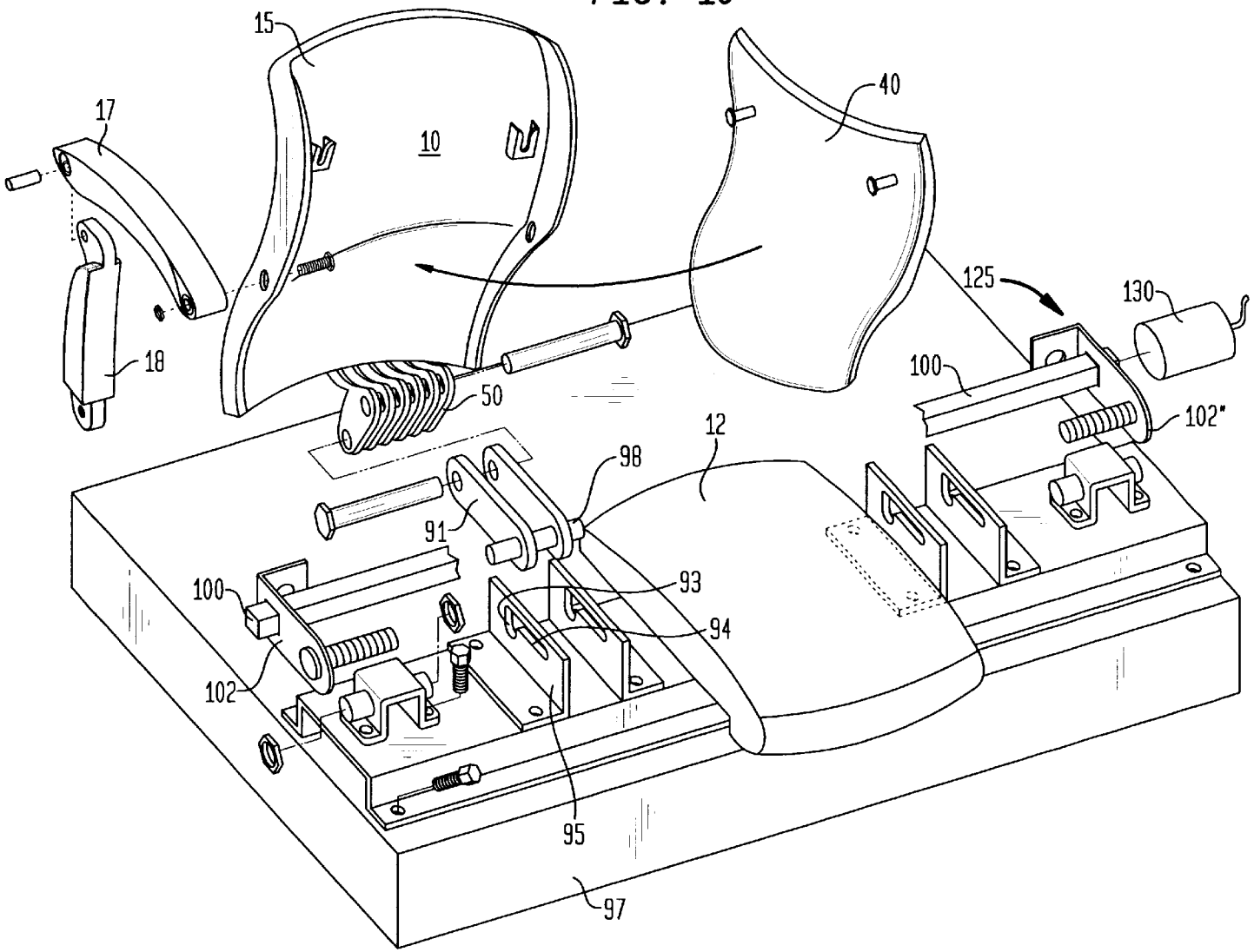
FIG. 10 is an exploded isometric representation of a specific illustrative embodiment of the invention installed on a seating level of a bleacher seating arrangement.

FIG. 10 is an exploded perspective representation of a specific embodiment of the invention. Elements of structure that bear analogous correspondence to those previously discussed are similarly designated. Additionally, certain elements of structure are illustrated schematically. FIG. 10 illustrates the assembly of bleacher chair 10 and its relationship to bleacher seating level 97 and the mechanical elements of structure described hereinabove with respect to FIG. 9. This figure additionally shows that bleacher seating level 97 is arranged to receive an additional bleacher chair (not shown) at region 125 thereof. Thus, a plurality of bleacher chairs can be installed in side-by-side relation along substantially the entire length of bleacher seating level 97 and other bleacher seating levels (not shown) that may be disposed above and/or below bleacher seating level 97.

FIG. 10 additionally shows that rectangular rod 100 can be configured to extend across a plurality of bleacher chairs so as to cause simultaneous release of the corresponding plurality of seat backs. The figure shows, in schematic form, an actuator 130 which may be an electric motor or a solenoid that is arranged to cause the pivotal displacement of connecting links 102 ans 102", as previously described, to effect release of the seat backs to the fully reclined position. Of course, seat back release can be effected manually. In addition, some of the mechanism and actuation elements to effect the release can be contained beneath bleacher seating level 97.

Although the invention has been described in terms of specific embodiments and applications, persons skilled in the art can, in light of this teaching, generate additional embodiments without exceeding the scope or departing from the spirit of the invention described herein. Accordingly, it is to be understood that the drawing and description in this disclosure are proffered to facilitate comprehension of the invention, and should not be construed to limit the scope thereof.

What is claimed is:

1. A bleacher arrangement of the type having deployed and undeployed states for use with a plurality of seating level members each having first and second ends and arranged in sequentially elevated relation to one another by a first predetermined height, wherein each such seating level member is disposed substantially directly beneath an immediately superior seating level member in substantially stacked relation when the bleacher arrangement is in the undeployed state, and wherein each such seating level member is disposed beneath and forward of an immediately superior seating level member in stepped relation when the bleacher arrangement is in the deployed state; said bleacher arrangement comprising a plurality of seats disposed side-by-side on an associated one of the plurality of seating level members, each of said seats having:

a seat bottom coupled to said associated seating level member for accommodating a user of the bleacher arrangement, said seat bottom having forward and rear portions and arranged substantially parallel to said associated seating level member; and a seat back disposed in the rear portion of said seat bottom, said seat back being pivotally displaceable with respect to said associated seating level member between a first position where said seat back is disposed substantially orthogonal to said seat bottom and a second position where said seat back is reclined rearwardly to be substantially parallel to said seat bottom;

a guide bracket having a guide slot therein having respective portions for defining locked and unlocked conditions; and a linkage arrangement having a first portion pivotally coupled to said seat back and a second portion in engagement with the guide slot of the guide bracket, the second portion of said linkage arrangement being displaceable along the guide slot in response to translation between the first position of the seat back and the second position of the seat back.

2. The bleacher arrangement of claim 1, wherein the pivotal displacement of said seat back to the first position urges the second portion of said linkage arrangement to the portion of the guide slot corresponding to the locked condition.

3. The bleacher arrangement of claim 2, wherein there is further provided an unlocking arrangement for urging the second portion of said linkage arrangement from the portion of the guide slot corresponding to the locked condition to the portion of the guide slot corresponding to the unlocked condition.

4. The bleacher arrangement of claim 3, wherein said seat back is urged into the second position upon the second portion of said linkage arrangement being urged from the portion of the guide slot corresponding to the locked condition to the portion of the guide slot corresponding to the unlocked condition.

5. The bleacher arrangement of claim 4, wherein said seat back is urged into the second position in response to the force of gravity upon the second portion of said linkage arrangement being urged from the portion of the guide slot corresponding to the locked condition to the portion of the guide slot corresponding to the unlocked condition.

6. The bleacher arrangement of claim 3, wherein there is further provided an electrical actuator coupled to said unlocking arrangement for urging said unlocking arrangement to urge the second portion of said linkage arrangement from the portion of the guide slot corresponding to the locked condition to the portion of the guide slot corresponding to the unlocked condition.

7. The bleacher arrangement of claim 6, wherein said electrical actuator comprises a solenoid.

8. The bleacher arrangement of claim 6, wherein said electrical actuator comprises an electric motor.

9. The bleacher arrangement of claim 3, wherein said unlocking arrangement is configured to urge the second portion of said linkage arrangement from the portion of the guide slot corresponding to the locked condition to the portion of the guide slot corresponding to the unlocked condition for a plurality of said seats simultaneously.

* * * * *